US009033375B1

(12) United States Patent
Moon et al.

(10) Patent No.: US 9,033,375 B1
(45) Date of Patent: May 19, 2015

(54) ANTI-LIGATURE LOCKSET

(75) Inventors: Charles W. Moon, Colorado Springs, CO (US); Michael J. Wright, Santa Ana, CA (US)

(73) Assignee: Townsteel, Inc., City of Industry, CA (US)

( * ) Notice: Subject to any disclaimer, the term of this patent is extended or adjusted under 35 U.S.C. 154(b) by 131 days.

(21) Appl. No.: 13/595,271

(22) Filed: Aug. 27, 2012

(51) Int. Cl.
*E05C 1/06* (2006.01)
*E05B 1/00* (2006.01)

(52) U.S. Cl.
CPC ..... *E05B 1/003* (2013.01)

(58) Field of Classification Search
USPC ..... 292/140, 336.3
See application file for complete search history.

(56) References Cited

U.S. PATENT DOCUMENTS

| | | | | | |
|---|---|---|---|---|---|
| 1,548,371 | A * | 8/1925 | Moore | 292/164 |
| 2,242,327 | A * | 5/1941 | Rubinstein | 338/183 |
| 3,405,960 | A * | 10/1968 | Wargo | 292/145 |
| 3,746,923 | A * | 7/1973 | Spira et al. | 315/291 |
| 4,167,104 | A * | 9/1979 | Bond | 70/208 |
| 4,818,000 | A * | 4/1989 | Bobrowski | 292/147 |
| 7,287,787 | B1 | 10/2007 | Tannone | |
| 2003/0226384 | A1* | 12/2003 | Shedd et al. | 70/107 |
| 2010/0126239 | A1 | 5/2010 | Berger | |
| 2011/0120024 | A1 | 5/2011 | Shilts | |
| 2011/0174026 | A1 | 7/2011 | Salvatore et al. | |

FOREIGN PATENT DOCUMENTS

GB 572148 A * 9/1945

* cited by examiner

*Primary Examiner* — Mark Williams
(74) *Attorney, Agent, or Firm* — Eric W. Cernyar

(57) ABSTRACT

An anti-ligature door latch assembly comprises a door latch, an escutcheon, and an anti-ligature handle mounted to the escutcheon for movement along a guided linear path between a default non-operative position and an operative latch-retracting position. The anti-ligature handle includes a shroud that maintains contact with the escutcheon regardless of the position of the handle on the escutcheon and covers a linear slot in the escutcheon along which the handle rides. The anti-ligature door latch assembly is suitable for both mortise and tubular latch assemblies. The escutcheon and a back plate mounted to the door surface houses an activator plate that moves linearly with the handle. The activator plate has a cam surface that, when in the operative latch-retraction position, contacts a cooperating part of a spindle-mounted rotary hub, causing the spindle to rotate and retract the latch.

16 Claims, 8 Drawing Sheets

ANTI-LIGATURE LOCKSET

FIELD OF THE INVENTION

This invention relates to locksets or latch assemblies and associated trim assemblies, and in particular to anti-ligature assemblies designed to thwart attempts to affix or hang ligatures to the door handle.

BACKGROUND OF THE INVENTION

In special care environments and institutional settings, there is sometimes a need for furniture and room designs, including ligature-resistant door trim designs, that eliminate opportunities for a person to harm themselves. For example, if a door includes an inside handle, the handle should not provide an attachment point for a ligature that would enable a person to hang or strangle themselves.

Industry representatives have begun drafting a standard for hardware ligature attachment resistance. Under one proposal, a ligature-resistant device would be required to withstand a test wire comprising a nylon cord, plastic coated fabric, or plastic coated metal core with a diameter of 20 thousandths of an inch and a breaking strength of at least 4.5 foot-pounds. The test wire would be tied with a slip knot around the device as closely to the mounting fixture (e.g., an escutcheon) as possible, and a load of 1.1 foot-pounds would be applied sequentially in five directions, four at right angles in a direction parallel with the mounting fixture, and one perpendicular and away from the mounting fixture. To qualify as a ligature-resistant device, the test wire should slip off the device under each of those conditions.

SUMMARY OF THE INVENTION

A door latch assembly comprises a door latch, an escutcheon, and a handle mounted to the escutcheon for movement along a guided linear path between a default non-operative position and an operative latch-retracting position. The handle includes a shroud that maintains contact with the escutcheon regardless of the position of the handle on the escutcheon and covers a linear slot in the escutcheon along which the handle rides.

The escutcheon and a back plate mounted to the door surface houses an activator plate that moves linearly with the handle. The activator plate has a cam surface that, when in the operative latch-retraction position, contacts a cooperating part of a spindle-mounted rotary hub, causing the spindle to rotate and retract the latch.

The door latch assembly is suitable for both mortise and tubular latch assemblies. It is also suitable to be assembled in both vertical and horizontal positions. In an anti-ligature embodiment, the handle includes no apertures for attachment of a ligature, and the trim assembly is capable of satisfying the proposed industry standard described in the background section of the application.

These and other features of the invention will be appreciated in connection with the drawings and the detailed description below.

BRIEF DESCRIPTION OF THE DRAWINGS

The invention will now be described in reference to the following drawings in which.

DETAILED DESCRIPTION OF THE INVENTION

Figures 1A, 1B:
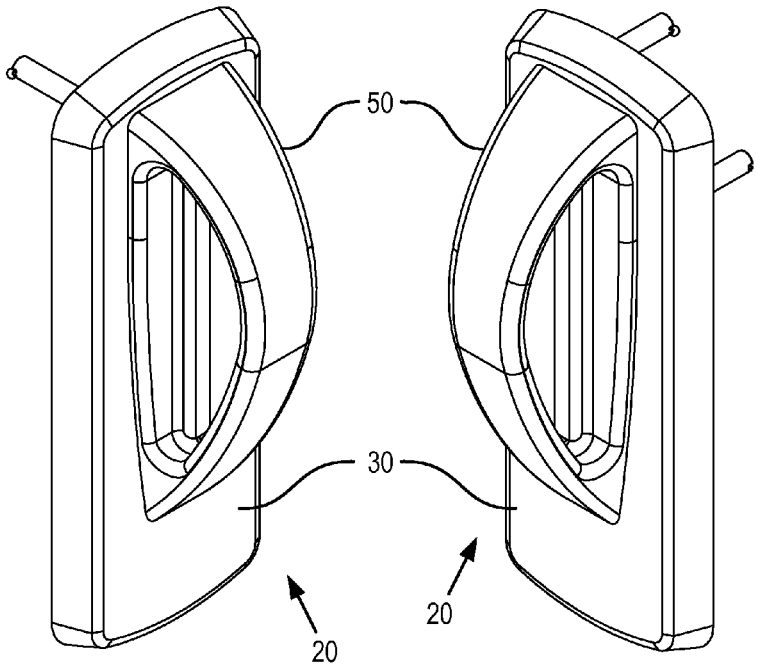
FIGS. 1A and 1B are perspective views from different front viewing angles of one embodiment of a trim assembly.
Figure 1C:
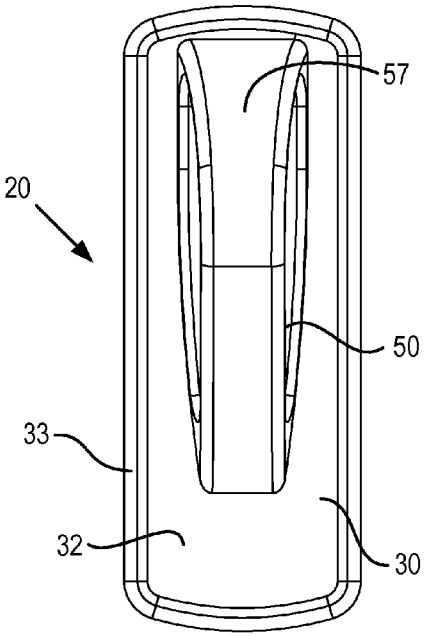
FIG. 1C is a front plan view of the trim assembly of FIGS. 1A and 1B.
Figure 1D:
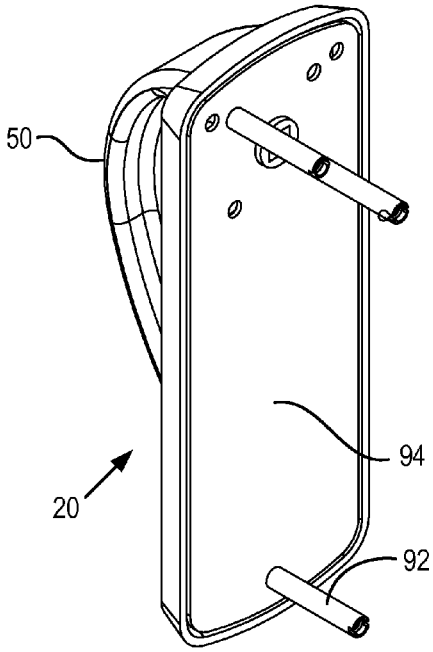
FIG. 1D is a perspective view of the trim assembly of FIGS. 1A and 1B from a back viewing angle.
Figure 2:
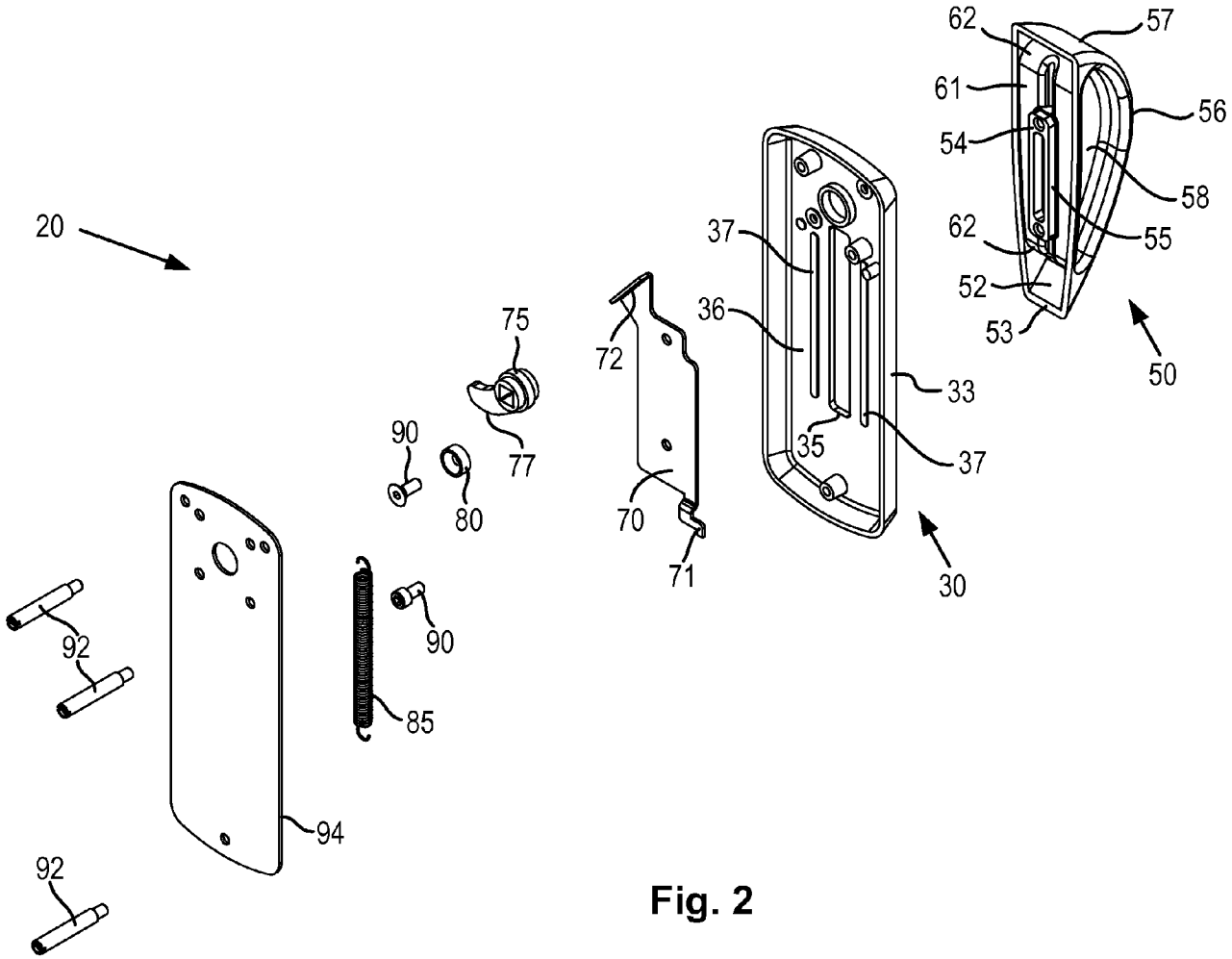
FIG. 2 is an exploded view diagram of the trim assembly of FIGS. 1A-1D.

In describing preferred and alternate embodiments of the technology described herein, as illustrated in FIGS. 1-8, specific terminology is employed for the sake of clarity. The technology described herein, however, is not intended to be limited to the specific terminology so selected, and it is to be understood that each specific element includes all technical equivalents that operate in a similar manner to accomplish similar functions.

FIGS. 1-8 illustrate various embodiments of a trim assembly suitable for both mortise and tubular latch assemblies. The trim assembly is also suitable for, but not restricted to, anti-ligature assemblies. In some embodiments, the latch assembly 10 comprises a door latch 12, a mortise or tubular latch body 15 (such as a mortise body) to operate the door latch, optionally a deadbolt assembly 18, and a trim assembly 20. The trim assembly 20 comprises a handle 50 mounted to an escutcheon 30 for movement along a guided linear path between a default non-operative position and an operative latch-retracting position.

The escutcheon 30 has a planar outer surface 32 and tapered side surfaces 33, the only parts that are exposed to the outside of the door after being mounted. The escutcheon 30, together with a back plate 94 that is mounted to it via posts 92, houses a linearly moving activator plate 70, a rotary hub 75 with a spindle aperture that mounts onto a spindle (not shown) projecting out of the mortise or tubular latch body 15, and a spring 85 that biases the activator plate away from its operatively engaging position with the rotary hub 75. The escutcheon 30 is designed so that the entire escutcheon 30, except for the guide ribs 37, can be cast. The guide ribs 37 alone are machined, and to a tight tolerance that provides a close anti-ligature fit between the handle 50 and the escutcheon 30. Also, the two posts 10 closest to the rotary hub 75 index the trim assembly 20 to the latch body 15.

The handle 50 is a full-hand handle that provides twist-free, spring-biased linear operation. The handle 50 comprises an elongated crescent-shaped hand-hold 56 with a smooth outer projecting surface 57 and opposite inwardly recessed or indented hand-engaging portions 58 for grasping by a hand to operate the door handle. The outer crescent shape of the handle subtends an angle of less than 180 degrees, so that any ligature will, by force applied in any direction, including gravity, slip off of the handle 150. In non anti-ligature embodiments, the handle 50 has an opening between the outer projecting surface 57 and the base of the handle 50. In anti-ligature embodiments, the handle 50 has no opening through which a ligature could be passed. The handle 50 is both shaped and secured closely to the escutcheon 30, within a very tight tolerance, in a manner configured to inhibit looping or tying of a rope or other ligature device to the handle.

A concealed part of the handle 50 (concealed when mounted on the escutcheon 30) comprises a low-friction surface planar portion 61 with roundly tapered top and bottom edges 62 and an elongated guide block 54, centered along a center line of the planar portion 61. The guide block 54 is mounted for guided linear movement within a linear slot 35 of the escutcheon 30. The close tolerance between the slot's linear edges and the block's linear sides 55 resist rotational torque applied to the handle 50.

The anti-ligature handle 50 also comprises a shroud or skirt 52 formed continuously with the hand-hold 56. The shroud 52 has an edge 53 defining a closed boundary within a plane. When the handle 50 is mounted to the escutcheon 30, the edge 53 of the shroud 52 maintains continuous contact with the planar outer surface 32 of the escutcheon 30 regardless of the position of the handle 50 on the escutcheon 30. As the handle 50 travels along the length of the slot 35, the shroud 52 completely conceals the slot 35 regardless of the position of the handle 50 on the escutcheon 30.

Figure 3A:
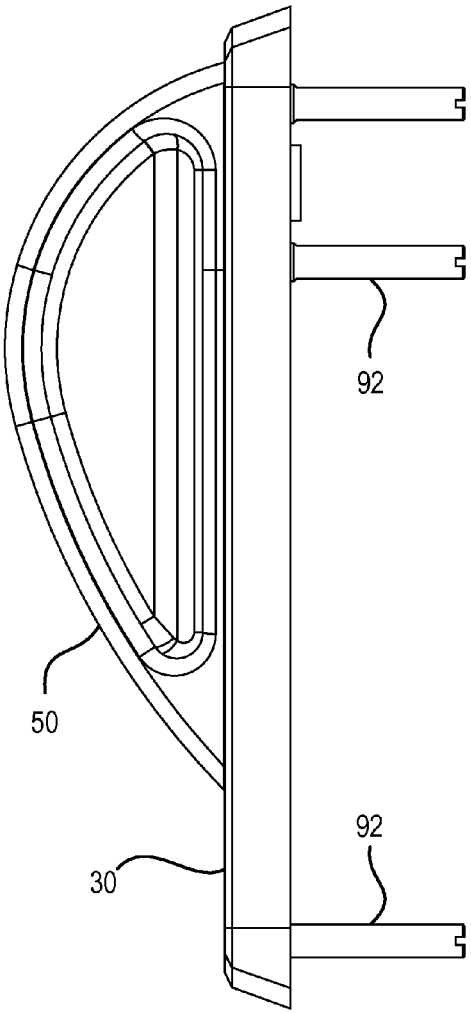
FIG. 3A is a side plan view of the trim assembly of FIGS. 1A-1D when the handle is in a non-operative position.
Figure 3B:
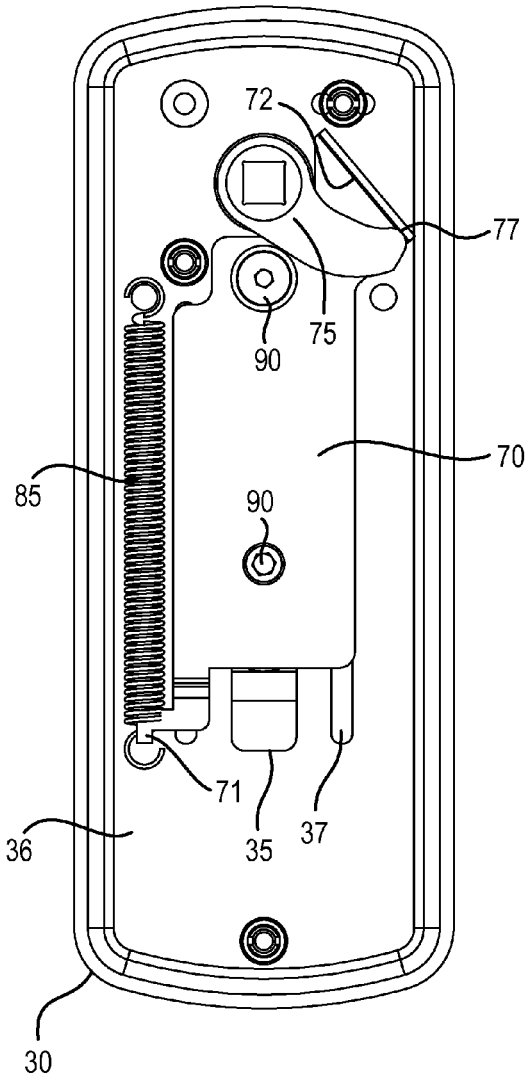
FIG. 3B is a back plan view of the trim assembly of FIG. 3A, not including the back plate, exposing the components inside the trim assembly when the handle is in a non-operative position.
Figure 4A:
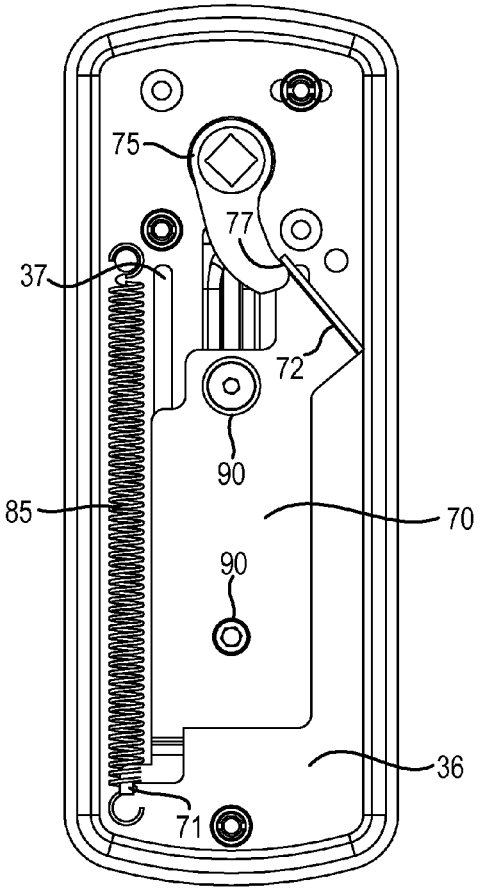
FIG. 4A is a back plan view of the trim assembly of FIGS. 1A-1D, not including the back plate, when the handle is in an operative position, exposing the components inside the trim assembly in a position operative to turn a spindle hub to retract the latch.

As best illustrated in FIGS. 3B and 4A, the trim assembly 20 also comprises a spring-mounted, linearly traveling activator plate 70 configured to be mounted adjacent an inside surface 36 of the escutcheon 37, and more particularly along low-friction glide guide ribs 37 of the escutcheon 30, for linear movement with the handle 50. The activator plate 70 is fixedly mounted via fasteners 90 to the guide block 54 of the handle 50 for linear movement therewith. The activator plate 70 has an angled cam surface 72 operable to contact a cooperating part or corresponding cam surface 77 of a rotary hub 75 to convert the linear motion of the handle 50 and activator plate 70 into rotary motion of the rotary hub 75. The rotary hub 75 is mounted on a spindle (not shown) operative to retract a door latch 12.

Figure 4B:
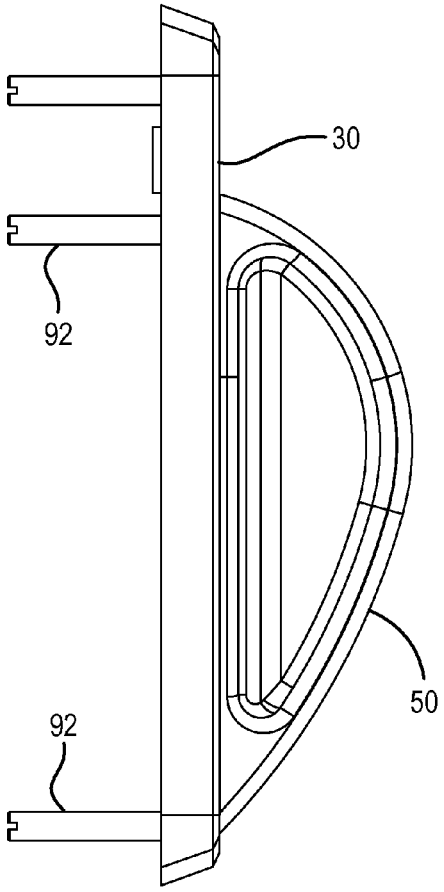
FIG. 4B is a side plan view of the trim assembly of FIG. 4A when the handle is in the operative position.

The activator plate 70 also has a spring tab 71 on which one end of a coil spring 85 is mounted, biasing the activator plate 70 into a non-operative position that does not engage the rotary hub 75 into a latch-retracting position. FIGS. 3A and 3B illustrate the trim assembly 20 in a non-operative position. FIGS. 4A and 4B, by contrast, illustrate the trim assembly 20 in an operative position.

Figure 5A:
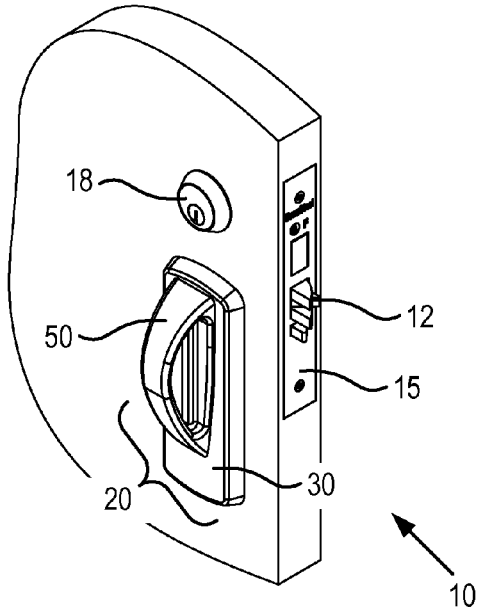
FIG. 5A is a perspective view of one embodiment of a latchset or lockset incorporating the trim assembly of FIGS. 1A-1D in a vertical configuration.
Figure 5B:
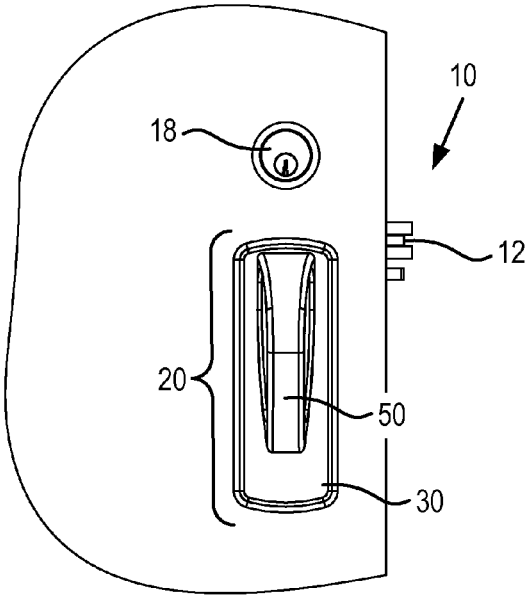
FIG. 5B is a front view of the latchset or lockset incorporating the trim assembly of FIG. 5A.
Figure 5C:
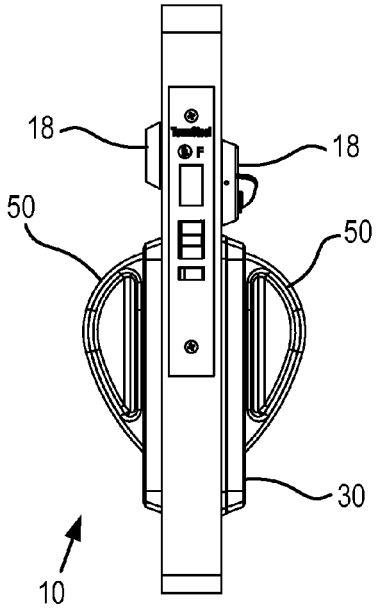
FIG. 5C is a side view of the latchset or lockset of FIG. 5A, revealing handles on both sides of the door, both of which are in a non-operative position.
Figure 6A:
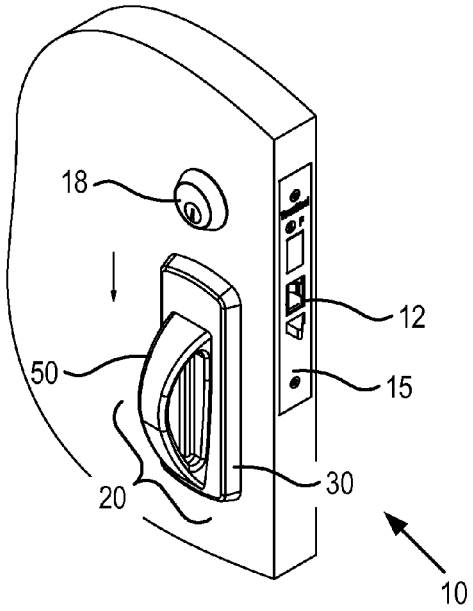
FIG. 6A is a perspective view of the latchset or lockset of FIG. 5A with the handle in an operative, latch-retracting position.
Figure 6B:
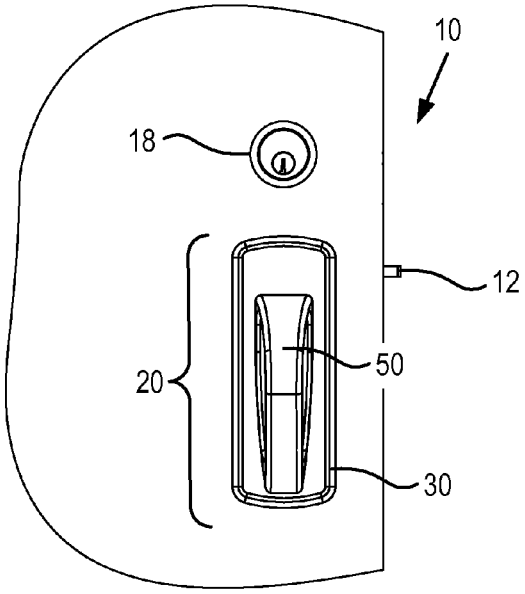
FIG. 6B is a front view of the latchset or lockset incorporating the trim assembly of FIG. 6A.
Figure 6C:
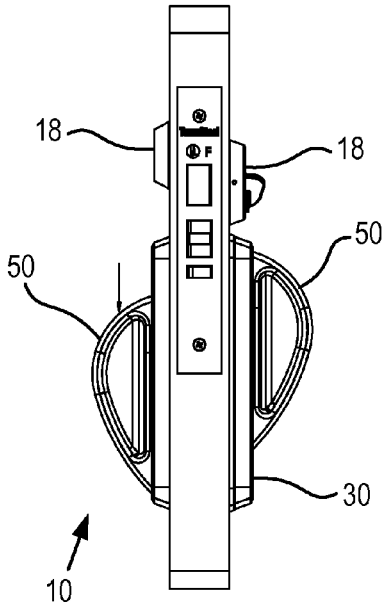
FIG. 6C is a side view of the latchset or lockset of FIG. 6A, revealing one of the two handles in the operative position, in contrast with the opposite handle, which is not in the operative position.
Figure 7A:
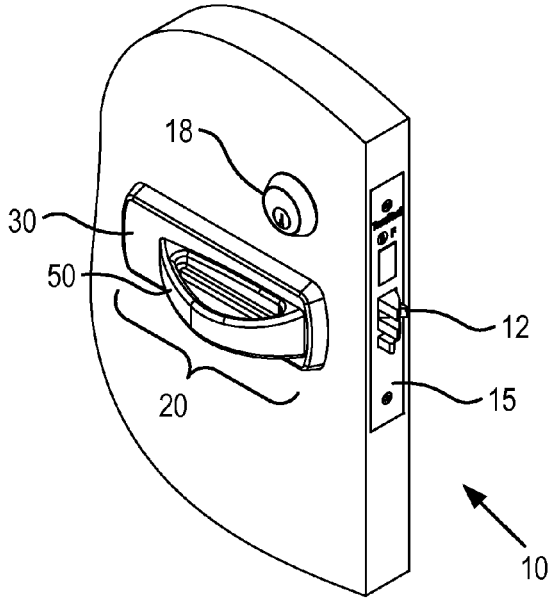
FIG. 7A is a perspective view of one embodiment of a latchset or lockset incorporating the trim assembly of FIGS. 1A-1D in a horizontal configuration.
Figure 7B:
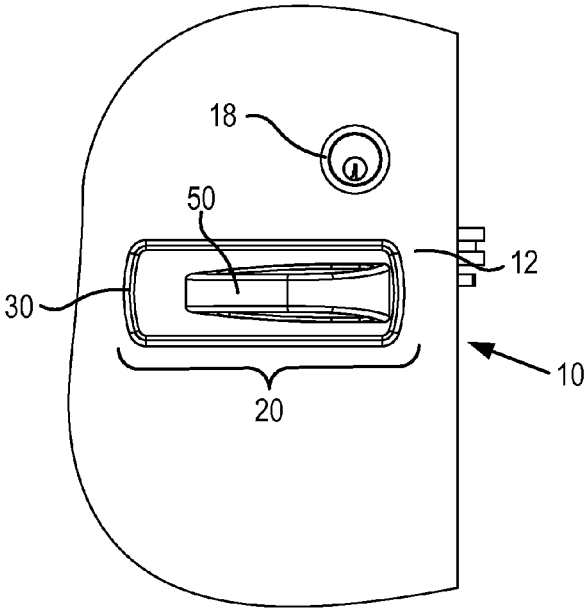
FIG. 7B is a front view of the latchset or lockset incorporating the trim assembly of FIG. 7A.
Figure 7C:
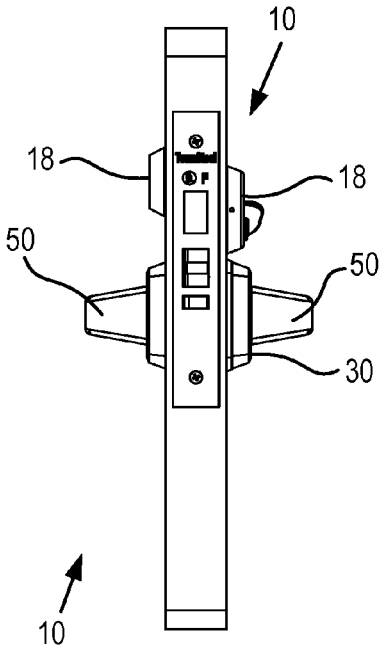
FIG. 7C is a side view of the latchset or lockset of FIG. 7A, revealing handles on both sides of the door, both of which are in a non-operative position.
Figure 8A:
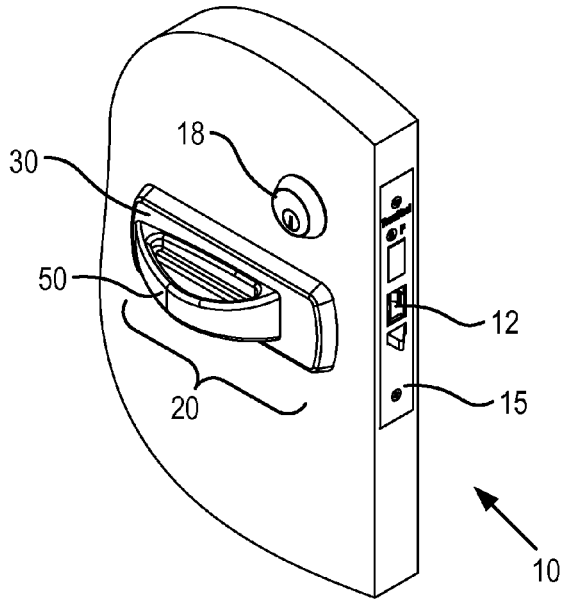
FIG. 8A is a perspective view of the latchset or lockset of FIG. 6A with the handle in an operative, latch-retracting position.
Figure 8B:
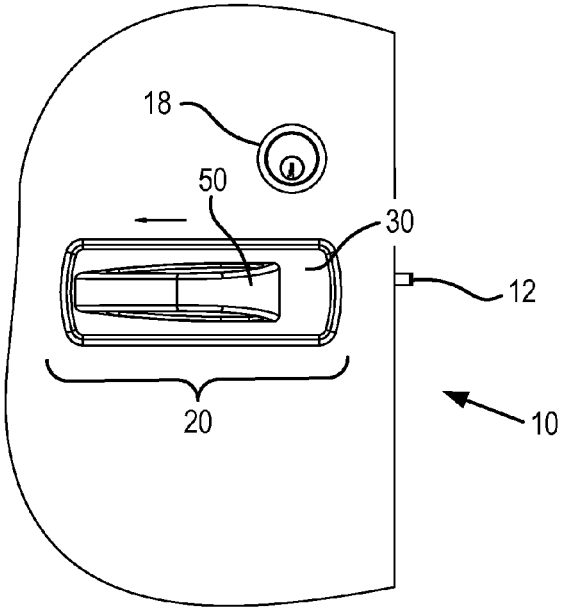
FIG. 8B is a front view of the latchset or lockset incorporating the trim assembly of FIG. 8A.
Figure 8C:
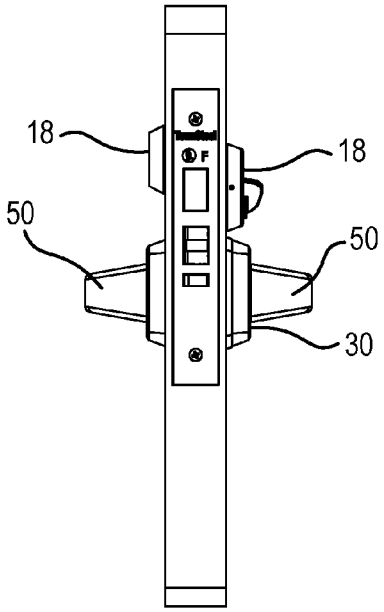
FIG. 8C is a side view of the latchset or lockset of FIG. 8A.

FIGS. 5 and 6 illustrate an embodiment of the latch assembly 10 in which the handles 50 are mounted vertically on a door. FIGS. 7 and 8, by contrast, illustrate an embodiment of the latch assembly 10 in which the handles 50 are mounted horizontally on the door. In FIGS. 5 and 7, each of the handles 20 is depicted in a non-operative configuration in which the latch 12 extends outwardly from the latch body 15. In FIGS. 6 and 8, one of the two handles 20 is depicted in an operative configuration in which the latch 12 is retracted into the latch body 15. In FIG. 6, one of the handles 20 is pushed down to retract the latch, and in FIG. 8, one of the handles 20 is pushed sideways.

It will be understood that many modifications could be made to the embodiments disclosed herein without departing from the spirit of the invention. Having thus described exemplary embodiments of the present invention, it should be noted that the disclosures contained in the drawings are exemplary only, and that various other alternatives, adaptations, and modifications may be made within the scope of the present invention. Accordingly, the present invention is not limited to the specific embodiments illustrated herein, but is limited only by the following claims.

We claim:

1. An anti-ligature trim assembly for a door comprising:

an escutcheon;

a linear slot in the escutcheon; and an anti-ligature handle operable to be mounted to the escutcheon for movement in the linear slot along a guided linear path between a default non-operative position and an operative latch-retracting position;

wherein the anti-ligature handle includes a shroud defined by a projecting rim around a perimeter of the handle, the projecting rim defining a closed boundary within a plane;

wherein when the handle is mounted to the escutcheon, the projecting rim of the shroud maintains contact with the escutcheon regardless of the position of the handle on the escutcheon;

wherein the projecting rim completely surrounds the linear slot, and the shroud completely conceals the linear slot, regardless of the position of the handle on the escutcheon, so that there is no external opening to the linear slot.

2. The anti-ligature trim assembly of claim 1, wherein the anti-ligature handle further comprises an elongated guide block that rides along the linear slot, the guide block having linear sides to resist rotational torque applied to the handle.

3. The anti-ligature trim assembly of claim 1, further comprising an activator plate configured to be mounted along an inside surface of the escutcheon for linear movement with the handle.

4. The anti-ligature trim assembly of claim 3, wherein the activator plate has a cam surface operable to contact a cooperating part of a rotary hub to convert the linear motion of the handle and activator plate into rotary motion of the rotary hub.

5. The anti-ligature trim assembly of claim 4, wherein the rotary hub is mounted on a spindle operative to retract a door latch.

6. The anti-ligature trim assembly of claim 1, wherein the handle comprises an elongated crescent-shaped outer projecting surface and opposite indented hand-engaging portions to facilitate grasping by a hand to operate the door handle.

7. An anti-ligature door latch assembly comprising:

a door latch;

an escutcheon;

a linear slot in the escutcheon; and an anti-ligature handle operable to be mounted to the escutcheon for movement in the linear slot along a guided linear path between a default non-operative position and an operative latch-retracting position;

wherein the anti-ligature handle includes a shroud defined by a projecting rim around a perimeter of the handle, the projecting rim defining a closed boundary within a plane;

wherein when the handle is mounted to the escutcheon, the edge of the shroud maintains contact with the escutcheon regardless of the position of the handle on the escutcheon;

wherein the projecting rim completely surrounds the linear slot, and the shroud completely conceals the linear slot, regardless of the position of the handle on the escutcheon, so that there is no external opening to the linear slot.

8. The anti-ligature door latch assembly of claim 7, further comprising a mortise latch assembly to operate the door latch.

9. The anti-ligature door latch assembly of claim 7, further comprising a tubular latch assembly to operate the door latch.

10. The anti-ligature door latch assembly of claim 7, wherein the anti-ligature handle further comprises an elongated guide block that rides along the linear slot, the guide block having linear sides to resist rotational torque applied to the handle.

11. The anti-ligature door latch assembly of claim 7, further comprising an activator plate configured to be mounted along an inside surface of the escutcheon for linear movement with the handle.

12. The anti-ligature door latch assembly of claim 11, wherein the activator plate has a cam surface operable to contact a cooperating part of a rotary hub to convert the linear motion of the handle and activator plate into rotary motion of the rotary hub.

13. The anti-ligature door latch assembly of claim 12, wherein the rotary hub is mounted on a spindle operative to retract a door latch.

14. The anti-ligature door latch assembly of claim 7, wherein the handle comprises an elongated crescent-shaped outer projecting surface and opposite indented hand-engaging portions to facilitate grasping by a hand to operate the door handle.

15. An anti-ligature trim assembly for a door comprising:

an escutcheon having a linear slot;

a handle with an elongated guide block configured to be mounted to the escutcheon for guided linear travel along the linear slot between a default non-operative position and an operative latch-retracting position, the guide block having linear sides to resist rotational torque applied to the handle;

an activator plate configured to be mounted along an inside surface of the escutcheon for linear movement with the handle;

the activator plate having a cam surface operable to contact a cooperating part of a rotary hub to convert the linear motion of the handle and activator plate into rotary motion of the rotary hub; and a shroud defined by a projecting rim around a perimeter of the handle, the projecting rim defining a closed boundary within a plane, wherein when the handle is mounted to the escutcheon, the edge of the shroud maintains contact with the escutcheon regardless of the position of the handle on the escutcheon, and wherein the projecting rim completely surrounds the linear slot, and the shroud completely conceals the linear slot, regardless of the position of the handle on the escutcheon, so that there is no external opening to the linear slot.

16. The trim assembly of claim 15, wherein the rotary hub is mounted on a spindle operative to retract a door latch.

* * * * *